US008869898B2

(12) United States Patent
Xu et al.

(10) Patent No.: US 8,869,898 B2
(45) Date of Patent: Oct. 28, 2014

(54) SYSTEM AND METHOD FOR PINPOINT FRACTURING INITIATION USING ACIDS IN OPEN HOLE WELLBORES

(75) Inventors: Ying Qing Xu, Tomball, TX (US); Tianping Huang, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 360 days.

(21) Appl. No.: 13/109,497

(22) Filed: May 17, 2011

(65) Prior Publication Data

US 2012/0292030 A1 Nov. 22, 2012

(51) Int. Cl.
*E21B 43/26* (2006.01)
*E21B 34/14* (2006.01)

(52) U.S. Cl.
CPC ..... *E21B 43/26* (2013.01); *E21B 34/14* (2013.01)
USPC ..... 166/308.1; 166/308.2; 166/305.1; 166/271

(58) Field of Classification Search
None
See application file for complete search history.

(56) References Cited

U.S. PATENT DOCUMENTS

| | | | |
|---|---|---|---|
| 2,224,538 | A | 12/1940 | Eckel et al. |
| 3,090,442 | A | 5/1963 | Cochran et al. |
| 3,220,481 | A | 11/1965 | Park |
| 3,220,491 | A | 11/1965 | Mohr |
| 3,776,258 | A | 12/1973 | Dockins, Jr. |
| 4,114,694 | A | 9/1978 | Dinning |
| 4,292,988 | A | 10/1981 | Montgomery |
| 4,429,747 | A | 2/1984 | Williamson, Jr. |
| 4,519,451 | A | 5/1985 | Gray et al. |
| 4,520,870 | A | 6/1985 | Pringle |
| 4,541,484 | A | 9/1985 | Salerni et al. |
| 4,653,586 | A | 3/1987 | Skinner |
| 4,718,494 | A | 1/1988 | Meek |
| 4,729,432 | A | 3/1988 | Helms |
| 4,823,882 | A | 4/1989 | Stokley et al. |
| 4,828,037 | A | 5/1989 | Lindsey et al. |
| 4,840,229 | A | 6/1989 | Proctor et al. |

(Continued)

FOREIGN PATENT DOCUMENTS

| | | | |
|---|---|---|---|
| EP | 1258594 | A2 | 11/2002 |
| GB | 2316967 | A | 3/1998 |

(Continued)

OTHER PUBLICATIONS

The Free Dictionary Online, The American Heritage Dictionary of the English Language, 2000, Houghton Mifflin Company, Updated 2009, Fourth Edition.*

(Continued)

*Primary Examiner* — Jennifer H Gay
*Assistant Examiner* — Caroline Butcher
(74) *Attorney, Agent, or Firm* — Parsons Behle & Latimer

(57) ABSTRACT

Downhole tools for pumping an acid into a wellbore prior to pumping a fracturing fluid comprise a housing and an actuator member disposed therein. The housing comprises a port that is initially placed in fluid communication with an acid so the acid can be pumped into the wellbore and is then placed in fluid communication with a fracturing fluid so the fracturing fluid can be pumped into the same location within the wellbore. The downhole tool may comprise a chamber having the acid disposed therein. Alternatively, the acid can be part of an acid slug disposed at a leading edge of a fracturing fluid being pumped through the downhole tool.

15 Claims, 3 Drawing Sheets

(56) References Cited

U.S. PATENT DOCUMENTS

| | | | | |
|---|---|---|---|---|
| 4,862,966 | A | 9/1989 | Lindsey et al. | |
| 4,893,678 | A | 1/1990 | Stokley et al. | |
| 4,915,172 | A | 4/1990 | Donovan et al. | |
| 4,967,841 | A | 11/1990 | Murray | |
| 5,036,920 | A | 8/1991 | Cornette et al. | |
| 5,146,992 | A | 9/1992 | Baugh | |
| 5,325,921 | A | 7/1994 | Johnson et al. | |
| 5,327,960 | A | 7/1994 | Cornette et al. | |
| 5,332,038 | A | 7/1994 | Tapp et al. | |
| 5,348,092 | A | 9/1994 | Cornette et al. | |
| 5,366,009 | A | 11/1994 | Cornette et al. | |
| 5,394,938 | A | 3/1995 | Cornette et al. | |
| 5,396,957 | A | 3/1995 | Surjaatmadja et al. | |
| 5,411,090 | A | 5/1995 | Cornette et al. | |
| 5,425,424 | A | 6/1995 | Reinhardt et al. | |
| 5,435,391 | A * | 7/1995 | Jones | 166/308.1 |
| 5,443,117 | A | 8/1995 | Ross | |
| 5,499,678 | A | 3/1996 | Surjaatmadja et al. | |
| 5,722,490 | A | 3/1998 | Ebinger | |
| 5,730,223 | A | 3/1998 | Restarick | |
| 5,732,775 | A | 3/1998 | Hudson et al. | |
| 5,960,881 | A | 10/1999 | Allamon et al. | |
| 6,053,248 | A | 4/2000 | Ross | |
| 6,065,535 | A | 5/2000 | Ross | |
| 6,079,496 | A | 6/2000 | Hirth | |
| 6,155,342 | A | 12/2000 | Oneal | |
| 6,186,236 | B1 | 2/2001 | Cox | |
| 6,216,785 | B1 | 4/2001 | Achee, Jr. et al. | |
| 6,253,861 | B1 | 7/2001 | Carmichael et al. | |
| 6,382,324 | B1 | 5/2002 | Anyan | |
| 6,530,574 | B1 | 3/2003 | Bailey et al. | |
| 6,533,037 | B2 | 3/2003 | Eslinger et al. | |
| 6,601,646 | B2 | 8/2003 | Streich et al. | |
| 6,832,654 | B2 | 12/2004 | Ravensbergen et al. | |
| 6,896,049 | B2 | 5/2005 | Moyes | |
| 6,923,262 | B2 | 8/2005 | Broome et al. | |
| 6,929,066 | B2 | 8/2005 | Hill | |
| 6,938,690 | B2 | 9/2005 | Surjaatmadja | |
| 7,066,264 | B2 | 6/2006 | Bissonnette et al. | |
| 7,066,265 | B2 | 6/2006 | Surjaatmadja | |
| 7,078,370 | B2 | 7/2006 | Crews | |
| 7,096,943 | B2 | 8/2006 | Hill | |
| 7,166,560 | B2 | 1/2007 | Still et al. | |
| 7,216,706 | B2 * | 5/2007 | Echols et al. | 166/285 |
| 7,331,388 | B2 | 2/2008 | Vilela et al. | |
| 7,469,744 | B2 | 12/2008 | Ruddock et al. | |
| 7,503,384 | B2 | 3/2009 | Coronado | |
| 7,546,878 | B2 * | 6/2009 | Prado et al. | 166/311 |
| 7,640,988 | B2 | 1/2010 | Phi et al. | |
| 7,673,673 | B2 | 3/2010 | Surjaatmadja et al. | |
| 7,703,510 | B2 | 4/2010 | Xu | |
| 7,819,193 | B2 | 10/2010 | Savoy et al. | |
| 7,841,411 | B2 | 11/2010 | Fuller et al. | |
| 2002/0117301 | A1 | 8/2002 | Womble | |
| 2002/0162661 | A1 | 11/2002 | Krauss et al. | |
| 2004/0140089 | A1 | 7/2004 | Gunneroed | |
| 2004/0211560 | A1 | 10/2004 | Richard et al. | |
| 2005/0061508 | A1 | 3/2005 | Surjaatmadja | |
| 2005/0279501 | A1 | 12/2005 | Surjaatmadja et al. | |
| 2006/0118301 | A1 | 6/2006 | East, Jr. et al. | |
| 2006/0191685 | A1 | 8/2006 | Coronado | |
| 2006/0196674 | A1 | 9/2006 | Butler et al. | |
| 2006/0283596 | A1 | 12/2006 | Mahdi et al. | |
| 2007/0029080 | A1 | 2/2007 | Moyes | |
| 2007/0039741 | A1 | 2/2007 | Hailey, Jr. | |
| 2007/0187095 | A1 | 8/2007 | Walker et al. | |
| 2007/0251690 | A1 | 11/2007 | Whitsitt et al. | |
| 2008/0035349 | A1 | 2/2008 | Richard | |
| 2008/0217025 | A1 | 9/2008 | Ruddock et al. | |
| 2009/0044944 | A1 | 2/2009 | Murrary et al. | |
| 2009/0044945 | A1 | 2/2009 | Willberg et al. | |
| 2009/0056934 | A1 | 3/2009 | Xu | |
| 2009/0084553 | A1 | 4/2009 | Rytlewski et al. | |
| 2009/0194273 | A1 | 8/2009 | Surjaatmadja et al. | |
| 2009/0260815 | A1 | 10/2009 | Malone | |
| 2009/0301708 | A1 | 12/2009 | Savoy et al. | |
| 2010/0126724 | A1 | 5/2010 | Surjaatmadja et al. | |
| 2011/0042082 | A1 * | 2/2011 | Schultz et al. | 166/270 |
| 2011/0114319 | A1 | 5/2011 | Xu et al. | |
| 2011/0187062 | A1 | 8/2011 | Xu | |
| 2011/0278010 | A1 * | 11/2011 | Fehr et al. | 166/308.1 |
| 2012/0012322 | A1 | 1/2012 | Korkmaz et al. | |

FOREIGN PATENT DOCUMENTS

| | | | |
|---|---|---|---|
| WO | WO 92/20900 | | 11/1992 |
| WO | WO 02/10554 | A1 | 2/2002 |
| WO | WO 02/068793 | A1 | 9/2002 |
| WO | WO 2004088091 | A1 | 10/2004 |

OTHER PUBLICATIONS

E. Paul Bercegeay, A One-Trip Gravel Packing System, Feb. 7, 1974, pp. 1-12, SPE 4771, American Institute of Mining, Metallurgical, and Petroleum Engineers, Inc., U.S.A.

Henry Restarick, Horizontal Completion Options in Reservoirs With Sand Problems, Mar. 11, 1995, pp. 545-560, SPE 29831, Society of Petroleum Engineers, Inc., U.S.A.

E. Harold Vickery, Application of One-Trip Multi-Zone Gravel Pack to Maximize Completion Efficiency, Oct. 12, 2000, pp. 1-10, SPE 64469, Society of Petroleum Engineers Inc., U.S.A.

Stephen P. Mathis, Sand Management: A Review of Approaches and Concerns, May 13, 2003, pp. 1-7, SPE 82240, Society of Petroleum Engineers Inc., U.S.A.

K.L. Smith, et al., "Ultra-Deepwater Production Systems Technical Progress Report," U.S. Department of Energy, Science and Technical Information, Annual Technical Progress Report, Jan. 2005, pp. 1-32, ConocoPhillips Company, U.S.A.

G.L. Rytlewski, A Study of Fracture Initiation Pressures in Cemented Cased Hole Wells Without Perforations, May 15, 2006, pp. 1-10, SPE 100572, Society of Petroleum Engineers, U.S.A.

Nicholas J. Clem, et al., Utilizing Computational Fluid Dynamics (CFD) Analysis as a Design Tool in Frac Packing Application to Improve Erosion Life, SPE Annual Technical Conference and Exhibition, Sep. 24-27, 2006, SPE 102209, Society of Petroleum Engineers, San Antonio, Texas, USA.

StageFRAC Maximize Reservoir Drainage, 2007, pp. 1-2, Schlumberger, U.S.A.

Brad Musgrove, Multi-Layer Fracturing Solution Treat and Produce Completions, Nov. 12, 2007, pp. 1-23, Schlumberger, U.S.A.

Notification of Transmittal of the International Search Report and the Written Opinion of the International Searching Authority, or the Declaration, Dec. 15, 2011, pp. 1-2, PCT/US2011/040805, Korean Intellectual Property Office.

International Search Report, Dec. 15, 2011, pp. 1-3, PCT/US2011/040805, Korean Intellectual Property Office.

Written Opinion of the International Searching Authority, Dec. 15, 2011, pp. 1-4, PCT/US2011/040805, Korean Intellectual Property Office.

* cited by examiner

SYSTEM AND METHOD FOR PINPOINT FRACTURING INITIATION USING ACIDS IN OPEN HOLE WELLBORES

BACKGROUND

1. Field of Invention

The invention is directed to downhole tools for use in acid treatment and fracturing in oil and gas wells, and in particular, to downhole tools having a sleeve capable of being moved to initially force an acid from the tool and into a formation of a wellbore and, without any additional intervention from the surface other than the continued pumping downward of a fracturing fluid, force the fracturing fluid from the tool and into the formation.

2. Description of Art

Fracturing or "frac" systems or tools are used in oil and gas wells for completing and increasing the production rate from the well. In deviated well bores, particularly those having longer lengths, fracturing fluids can be expected to be introduced into the linear, or horizontal, end portion of the well to frac the production zone to open up production fissures and pores therethrough. For example, hydraulic fracturing is a method of using pump rate and hydraulic pressure created by fracturing fluids to fracture or crack a subterranean formation.

In addition to cracking the formation, high permeability proppant, as compared to the permeability of the formation can be pumped into the fracture to prop open the cracks caused by a first hydraulic fracturing step. For purposes of this disclosure, the proppant is included in the definition of "fracturing fluids" and as part of well fracturing operations. When the applied pump rates and pressures are reduced or removed from the formation, the crack or fracture cannot close or heal completely because the high permeability proppant keeps the crack open. The propped crack or fracture provides a high permeability path connecting the producing wellbore to a larger formation area to enhance the production of hydrocarbons.

Prior to the pumping of fracturing fluids into the wellbore, it is sometimes desirable to pump acids or other fluids into the formation to remove debris and other matter that could interfere with the pumping of the fracturing fluids into the formation. To do so, downhole tools are generally re-oriented or reconfigured between the steps of pumping acid and pumping fracturing fluid. Alternatively, the ports from which the acid is pumped into the formation is different from the ports in which the fracturing fluid is pumped. Thus, without additional intervention, the efficacy of the fracturing fluid is reduced because it is not being pumped into the location where the acid was previously pumped.

SUMMARY OF INVENTION

Broadly, the downhole tools described herein include a housing having a port through which an acid and then a fracturing fluid is pumped so that the acid and the fracturing fluid can be pumped into the same location within the wellbore. In one embodiment, the port is initially blocked by a movable actuator member. An acid slug disposed at a leading edge of a fracturing fluid is pumped down hole by the fracturing fluid. The downward pressure of the acid slug and the fracturing fluid actuates the actuator member causing the port to become un-blocked. The acid slug is then pumped through the port and into the wellbore. Upon depletion of the acid forming the acid slug, the fracturing fluid is pumped through the port into the same location where the acid was previously being pumped. As a result, the acid and the fracturing fluid can be pumped into the same location without any additional intervention in the well.

In another specific embodiment, the actuator member is operatively associated with a chamber. The chamber is in fluid communication with the port and is initially isolated from the bore of the housing. Actuating of the actuator member forces the acid from the chamber through the port and into the wellbore. In some embodiments, the port is initially blocked by a fluid flow restriction device such as a rupture disk or a one-way check valve that permit fluid to flow through them only after a predetermined pressure within the chamber is reached.

In one specific embodiment, the chamber is moved out of fluid communication with the port and the port is placed in fluid communication with the bore of the housing at a predetermined point during actuation of the actuator member. As a result, a fracturing fluid, which is being pumped into the bore of the housing causing the actuation of the actuator member, is permitted to flow through the port and into the wellbore. Thus, the fracturing fluid is pumped into the wellbore at the same location where the acid was previously being pumped. Accordingly, the probability that the acid and the fracturing fluid will be pumped at force into the same localized area of the wellbore is increased, thereby allowing a point within the wellbore to be pinpointed as the point of fracturing. For example, the acid that flows out the port can chemically react with nearby formation rock to create weak spots near the port for easily initiation fractures by the following fracturing fluid. Additionally, the acid and the fracturing fluid can be pumped into the same location without any additional intervention in the well.

In one specific embodiment, the actuator member comprises a recess on an outer wall surface that permits the isolation of the chamber from the bore of the housing to be compromised, thereby allowing acid to leak into the bore of the housing.

Figure 1:
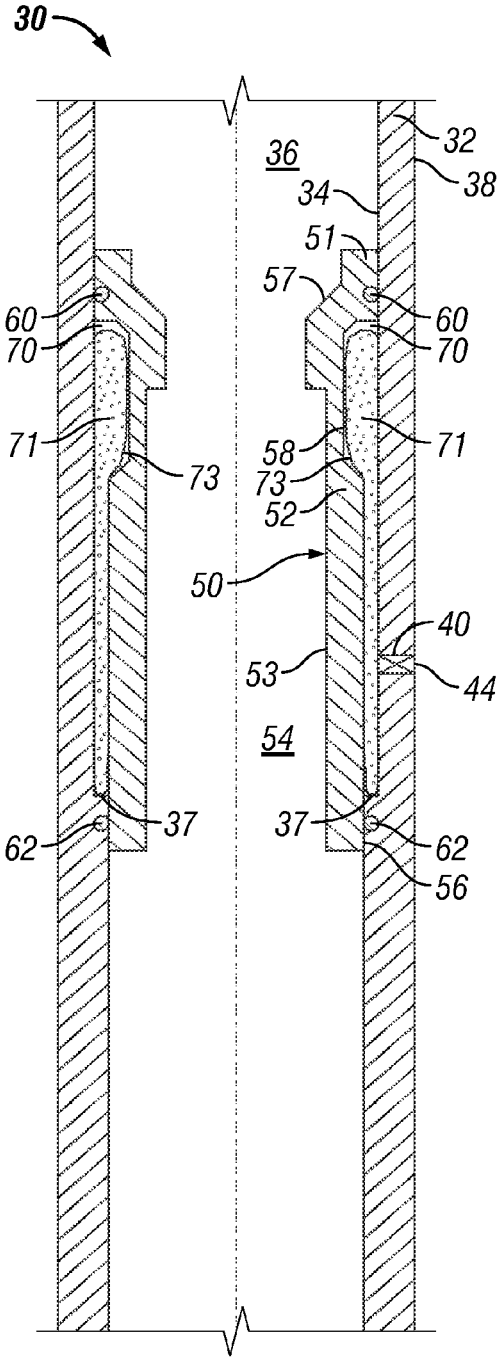
FIG. 1 is a partial cross-sectional view of one specific embodiment of the downhole tool disclosed herein shown in the run-in position.
Figure 2:
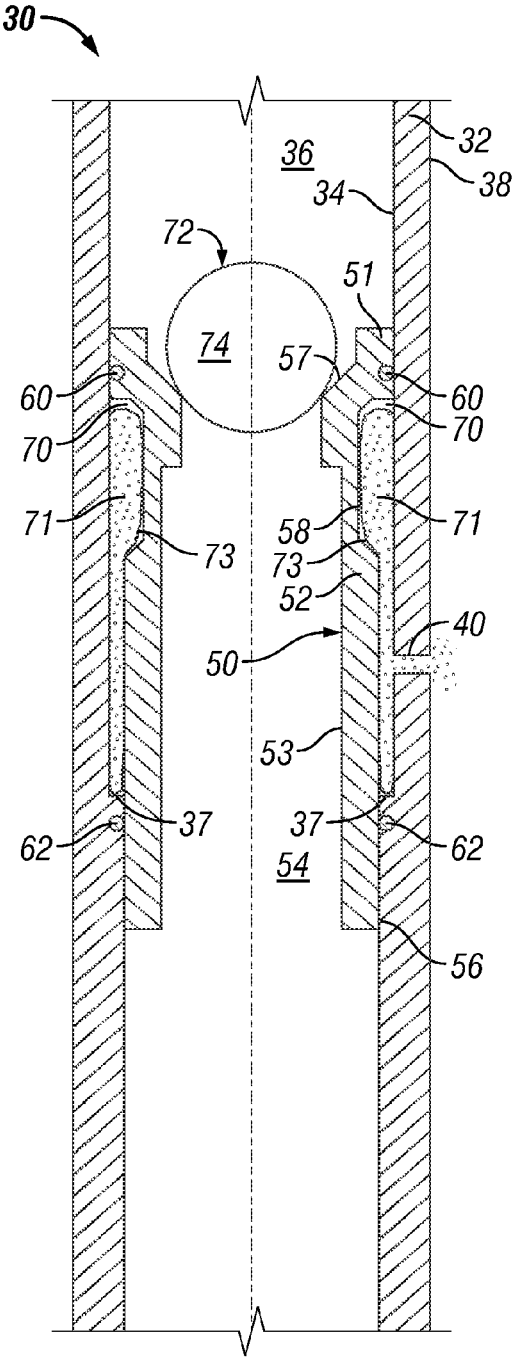
FIG. 2 is a partial cross-sectional view of the downhole tool of FIG. 1 shown with a plug element landed on a seat prior to actuating of the downhole tool of FIG. 1.
Figure 3:
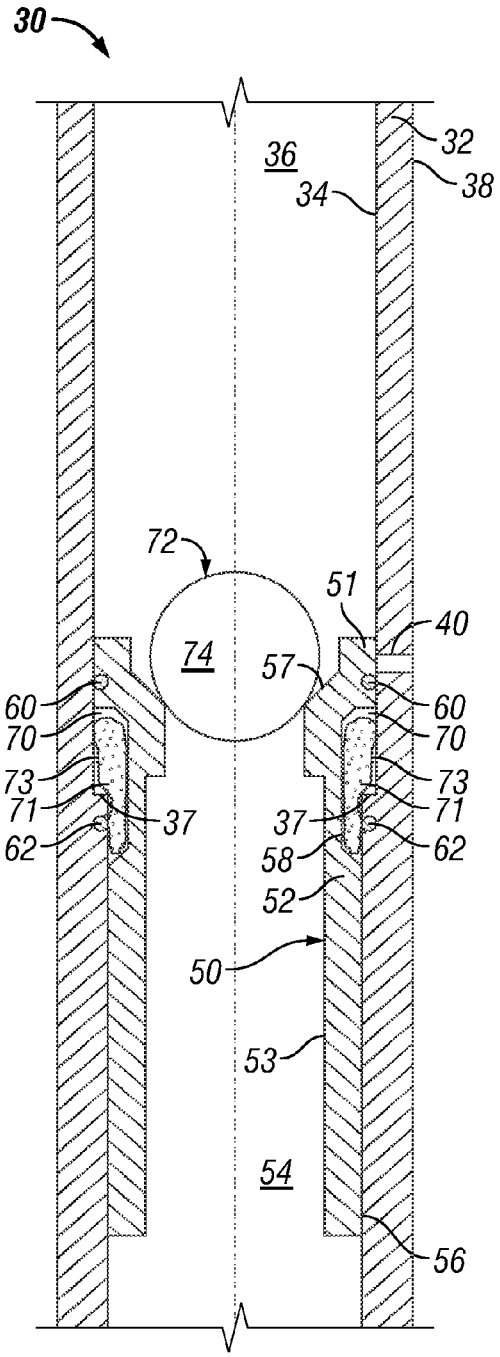
FIG. 3 is a partial cross-sectional view of the downhole tool of FIG. 1 shown in one of a plurality of actuation positions which are provided during actuation of the downhole tool of FIG. 1.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Referring now to FIGS. 1-4, downhole tool 30 comprises housing 32 having inner wall surface 34 defining bore 36, and outer wall surface 38. In the embodiment of FIGS. 1-4, shoulder 37 is disposed on inner wall surface.

Port 40 is disposed in housing 32 and in fluid communication with bore 36 and outer wall surface 38. Port 40 may include fluid flow restriction device 44 which can be a rupture disk, a one-way check valve, or the like. In embodiments in which fluid flow restriction device 44 is a rupture disk, when the pressure acting on the rupture disk is increased to a predetermined level, the rupture disk breaks or ruptures placing port 40 in fluid communication with the wellbore. In the embodiments in which a one-way check valve in disposed in port 40, when the pressure acting on the one-way check valve in the direction of permitted flow reaches a predetermined pressure, fluid is permitted to flow through port 40 into the wellbore. Because of the one-way check valve, however, no fluid is permitted to flow into from the wellbore through port 40.

Actuator 50 initially blocks fluid communication between bore 34 and port 40. In the embodiment of FIGS. 1-4, actuator 50 comprises sleeve 52 in sliding engagement with inner wall surface 34. Sleeve 52 includes inner wall surface 53 defining sleeve bore 54, and outer wall surface 56. Upper seal 60 is disposed along outer wall surface 56 at upper end 51 of sleeve 52 to reduce the likelihood of leaks between inner wall surface 34 and outer wall surface 56 of sleeve 52. Lower seal 62 is disposed on inner wall surface 34 below shoulder 37 to reduce the likelihood of leaks between inner wall surface 34 and outer wall surface 50 of sleeve 52 until the point at which lower seal 62 is disposed opposite recess 58 (FIGS. 3-4), at which time lower seal 62 is compromised or breached so that a leak path is formed between inner wall surface 34 and outer wall surface 56 of sleeve 52.

Sleeve 52, inner wall surface 34, and shoulder 37 define chamber 70 which is in fluid communication with port 40. In the embodiment of FIGS. 1-4, outer wall surface 56 of sleeve 52 comprises recess 58 disposed toward upper end 51 of sleeve 52. Acid 71 is disposed in chamber 70 and is maintained within chamber 70 such as through fluid flow restriction device 44. In the particular embodiment shown in FIGS. 1-4, acid 71 is disposed within compressible reservoir 73 such as a bag made out of polyethylene. An interior of compressible reservoir 73 is in fluid communication with port 40.

Acid 71 may be any acid desired or necessary to provide the desired result of removing debris and other matter from the wellbore, and/or react with the formation rock matrix to create weak spots, prior to fracturing fluid being pumped into the wellbore. Suitable acids include hydrochloric acid, hydrofluoric acid, sulfuric acid, methanesulfonic acid, sulfonic acid, phosphoric acid, nitric acid, sulfamic acid, other organic acids, and mixtures thereof.

In the embodiment of FIGS. 1-4, actuator 50 comprises seat 57 disposed at upper end 51. Seat 57 is shaped to receive a plug member 72 such as ball 74. Although FIGS. 1-4 show seat 57 as a ball seat for receiving ball 74, it is to be understood that seat 57 is not required to be a ball seat and plug element 72 is not required to be ball 74. Instead, seat 57 can have any other shape desired or necessary for receiving a reciprocally shaped plug element 72.

In operation of the embodiment of FIGS. 1-4, downhole tool 30 is disposed in a tubing string (not shown) through attachment members (not shown) disposed at the upper and lower ends of housing 32 and run-in a wellbore to a desired location or depth. The desired location is determined by the alignment of port 40 with the portion of the wellbore where fracturing operations are to be performed. After locating downhole tool 30 in the wellbore, plug element 72 is dropped down the bore of the tubing string and into bore 36 where it lands on seat 57. As a result, fluid flow through bore 36 and, thus, seat 57 is restricted. One or more fracturing fluids (not shown) is pumped down the tubing string and into bore 36 forcing plug element 72 downward into seat 57. The continued pumping of fracturing fluid(s) into bore 36 increases the pressure above seat 57. Upon reaching a predetermined pressure, shear pins (not shown) or other restraining devices are disengaged allowing sleeve 52 to slide along inner wall surface 34 of housing 30. Alternatively, the frictional forces between outer wall surface 56 of sleeve 52 and inner wall surface 34 of housing 30 are overcome so that sleeve 52 slides downward along inner wall surface 34.

As sleeve 52 slide downwards, pressure within chamber 70 is increased due to the decrease in volume in chamber 70. As a result, acid 71, whether in chamber 70 or, as shown in the embodiment of FIGS. 1-4 within compressible reservoir 73 is forced out of chamber 70 and through port 40 into the wellbore. Facilitating pumping of acid 71 out of chamber 70 through port 40 can be the breaking of the rupture disk or the sufficient increase in pressure to flow through the one-way check valve. Alternatively, compressible reservoir 73 may rupture to release acid 71 into chamber 70 so that it can be forced through port 40.

Figure 4:
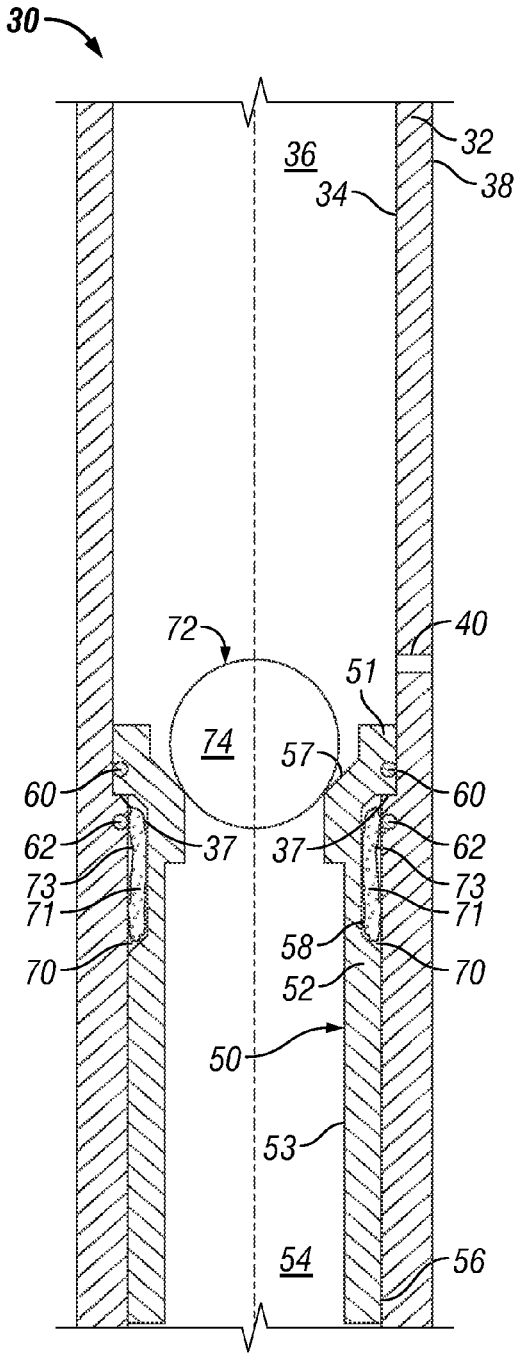
FIG. 4 is a partial cross-sectional view of the downhole tool of FIG. 1 shown after actuation of the downhole tool of FIG. 1.

Although pressure within chamber 70 is being relieved through port 40, the pressure above seat 57 continues to force sleeve 52 downward. At the point where recess 58 of sleeve 52 is disposed opposite lower seal 62 (FIG. 3), a leak path is created below lower seal 62 along the inner wall surface 34 of housing 30 and the outer wall surface 56 of sleeve 52. Thus, acid 71 is permitted to leak out of chamber 70, thereby preventing sleeve 52 becoming hydraulically locked by the build-up of pressure within chamber 70. Accordingly, sleeve 52 is permitted to continue to be moved downward until upper seal 62 crosses over port 40 (FIGS. 3-4) and sleeve 52 is ultimately moved downward below port 40 (FIG. 4). Upon sleeve 52 being moved below port 40, fracturing fluids being pumped down the tubing string and into bore 36 are permitted to flow through port 40 and into the wellbore. As a result, the fracturing fluids are pumped into the same location in the wellbore into which acid 71 was previously pumped.

Although the embodiment of FIGS. 1-4 includes acid 71 within compressible reservoir 73, it is to be understood that acid 71 could be disposed directly within chamber 70. In other words, compressible reservoir 73 is not required.

After sufficient fracturing fluid is injected into the well or open hole formation through port 40, plug element 72 can be removed from seat 57 through any method known to persons skilled in the art. For example, plug element 72 may be removed from seat 57 by increasing the fluid pressure of the fracturing fluid being pumped downward through bore 36 until plug element 72 is forced through seat 57 so that it can fall to the bottom of the well. Alternatively, plug element 72 may be removed from seat 57 by decreasing the fluid pressure of the fracturing fluid being pumped downward through bore 36 so that plug element 72 can float back to the surface of the well. In another method, plug element 72 can be dissolved by pumping a fluid, such as a weak acid, down the tubing string and into bore 36. In addition to dissolving plug element 72, sleeve 52 can also be dissolved. In still another method, plug element 72 and sleeve 57 can be milled out of bore 36.

Figure 5:
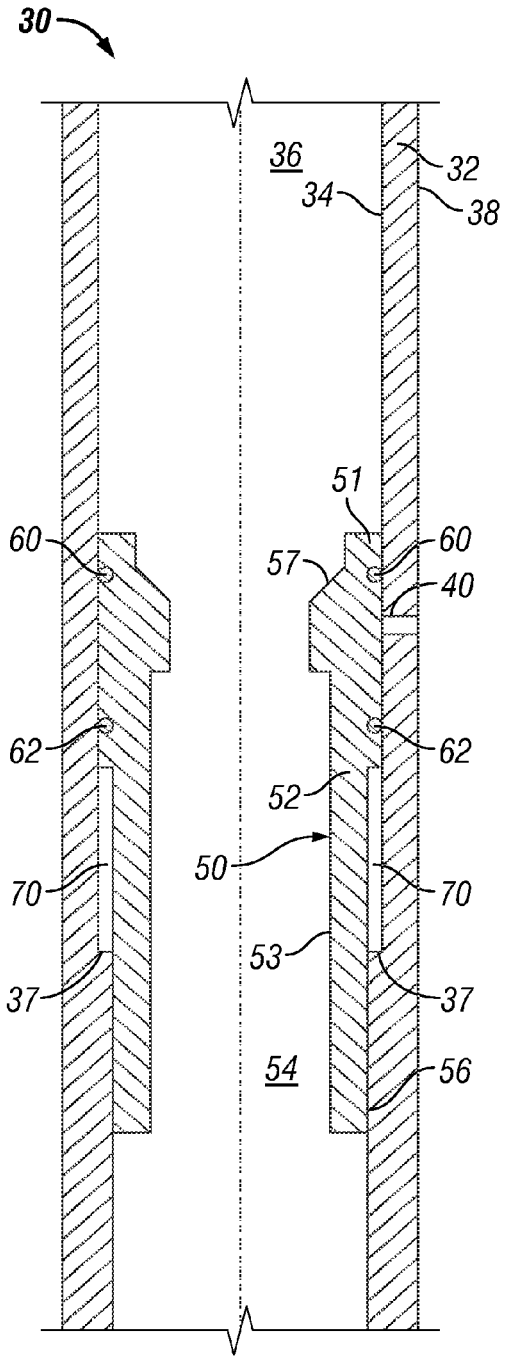
FIG. 5 is a partial cross-sectional view of another specific embodiment of the downhole tool disclosed herein shown in the run-in position.
Figure 6:
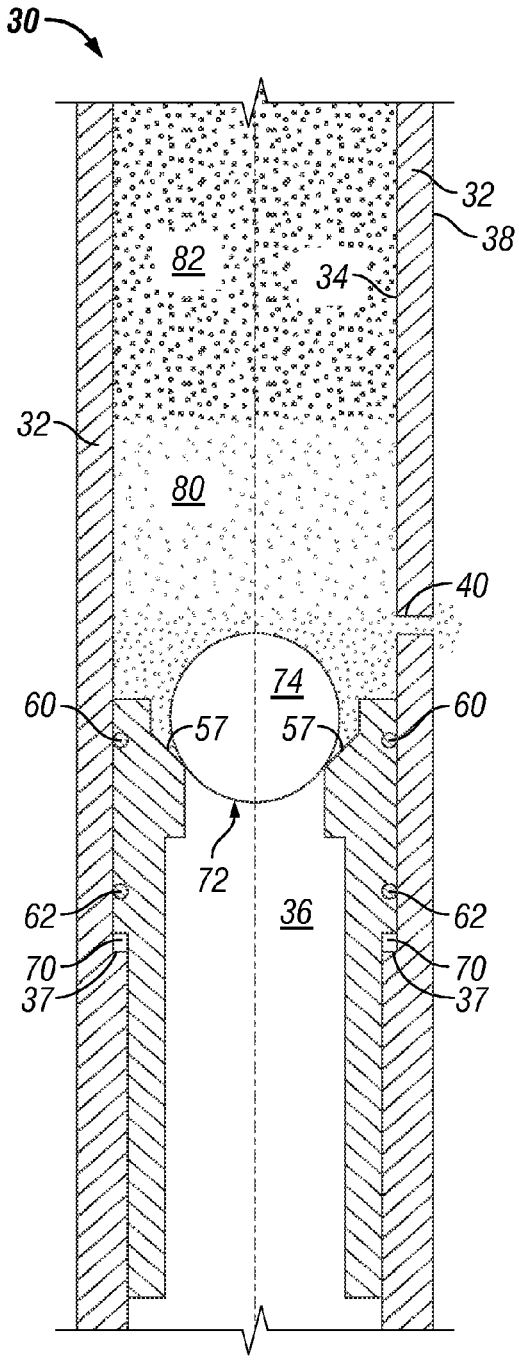
FIG. 6 is a partial cross-sectional view of the downhole tool of FIG. 5 shown with a plug element landed on a seat and the downhole tool of FIG. 5 actuated.

Referring now to FIGS. 4-5, in another embodiment, port 40 is not in fluid communication with chamber 70. Instead, sleeve 52 initially blocks port 40 (FIG. 5) with port 40 being isolated by upper seal 60 and lower seal 62. Because no seal is disposed below shoulder 37, a leak path is present below shoulder 37 between inner wall surface 34 of housing 30 and outer wall surface 56 of sleeve 52.

Plug element 72, shown as ball 74, is dropped down the tubing string and landed on seat 57. Acid slug 80 and fracturing fluid 82 are pumped down the tubing string and into bore 36. Acid slug 80 comprises a volume of acid fluid disposed between plug element 72 and a leading edge of fracturing fluid 82. Thus, acid slug 80 is pumped through port 40 before fracturing fluid 82 is pumped through port 40. After the pressure above seat 57 increases to a predetermined pressure due to acid plug 80 forcing plug element 72 downward, sleeve 52 moves downward placing port 40 in fluid communication with bore 36 and, thus, in fluid communication with acid slug 80. As a result, the acid making up acid slug 80 is forced through port 40 and into the wellbore before fracturing fluid 82 is forced through port 40 and in the wellbore. Therefore, the acid can pre-treat a certain location of formation rock near the port to create weak spots in the formation rock before the fracturing fluid enters the wellbore to initiate fractures at the created weak spots in the same location. Thus, the operator is able to more accurately pinpoint the location of the wellbore that will be fractured.

In an alternative embodiment of the embodiment of FIGS. 4-5, a third seal (not shown) can be disposed below shoulder 37 so that chamber 70 comprises an isolated atmospheric chamber. As a result, during operation chamber 70 becomes energized. Therefore, after fracturing operations are completed, the energized chamber 70 forces sleeve 52 back up to its initial position blocking port 40. Thus, downhole tool 30 can be relocated to one or more additional depths within the wellbore so that additional acid/fracturing fluid operations can be performed at more than one location.

Alternatively, chamber 70 may include a return member that can be energized when sleeve 52 is moved downward placing port 40 in fluid communication with bore 36. Suitable return members include coiled springs, belleville springs (also known as belleville washers), capillary springs, and deformable elastomers and polymers.

Similar to the embodiment of FIGS. 1-4, reduction of the fluid pressure of the fracturing fluid, either after forcing plug element 72 through seat 57, or to allow plug element 72 to float to the surface of the well, allows energized chamber 70, or the energized return member (not shown), to overcome the downward force of the fluid being, or previously being, pumped downward through bore 36. When the upward force of the energized chamber 70 or the energized return member overcomes the downward force of the fluid being, or previously being, pumped downward through bore 36, sleeve 52 begins to move until it again blocks port 40 such as shown in FIG. 5.

As will be recognized by persons of ordinary skill in the art, operation of all of the embodiments of FIGS. 1-4 and FIGS. 5-6 permits the acid and the fracturing fluids to flow through the same port which is disposed at the same location during pumping of both the acid and the fracturing fluid. In addition, all of the embodiments of FIGS. 1-4 and FIGS. 5-6 permit the acid to be pumped into the wellbore before the fracturing fluid without any additional well intervention using another tool or device. All that is required is the continued pumping of fracturing fluid down the tubing string and into the bore of the housing to facilitate pumping the acid first through the port and then the fracturing fluid through the port.

In the embodiments discussed herein with respect FIGS. 1-5, upward, toward the surface of the well (not shown), is toward the top of FIGS. 1-5, and downward or downhole (the direction going away from the surface of the well) is toward the bottom of FIGS. 1-5. In other words, "upward" and "downward" are used with respect to FIGS. 1-5 as describing the vertical orientation illustrated in FIGS. 1-5. However, it is to be understood that tool 30 may be disposed within a horizontal or other deviated well so that "upward" and "downward" are not oriented vertically.

It is to be understood that the invention is not limited to the exact details of construction, operation, exact materials, or embodiments shown and described, as modifications and equivalents will be apparent to one skilled in the art. For example, the return member may include a belleville spring (also known as belleville washers) or a deformable elastomer or rubberized element. Moreover, the return member may be an actuator energized by hydraulic pressure, hydrostatic pressure or electrical power such as from battery packs having electrical timers. Additionally, the actuator for moving the sleeve from the first position to the second position may be a piston that is actuated using hydrostatic or other pressure. Accordingly, the invention is therefore to be limited only by the scope of the appended claims.

What is claimed is:

1. A downhole tool comprising:

a housing having a housing outer wall surface, a housing inner wall surface defining a housing bore and a port, the port being in fluid communication with the housing bore and the housing outer wall surface;

a sleeve in sliding engagement with the housing inner wall surface, the sleeve comprising a sleeve inner wall surface defining a sleeve bore, a sleeve outer wall surface, and a seat disposed on an upper end of the sleeve, the sleeve outer wall surface and the housing inner wall surface defining a chamber, the chamber being in fluid communication with the port, wherein the chamber is initially isolated from the housing bore;

an acid initially disposed and maintained within the chamber prior to downward movement of the sleeve; and a plug element adapted to be disposed into the housing bore, the plug element landing on the seat and blocking fluid flow through the sleeve bore to enable fluid pressure to be applied to the housing bore for downward movement of the sleeve, the downward movement of the sleeve causing the acid to be forced through the port and out of the downhole tool.

2. The downhole tool of claim 1, wherein a fluid flow restrictor is disposed in the port, the fluid flow restrictor restricting the flow of the acid through the port during downward movement of the sleeve.

3. The downhole tool of claim 2, wherein the fluid flow restrictor comprises a rupture disk.

4. The downhole tool of claim 2, wherein the fluid flow restrictor comprises a one-way check valve.

5. The downhole tool of claim 1, wherein the acid is carried in a compressible reservoir disposed within the chamber, an interior of the compressible reservoir being in fluid communication with the port.

6. The downhole tool of claim 5, wherein the compressible reservoir comprises a polyethylene bag.

7. The downhole tool of claim 1, wherein the housing inner wall surface comprises a shoulder disposed within the chamber and the sleeve outer wall surface comprises a recess disposed toward the upper end of the sleeve, the shoulder being disposed opposite the recess when the sleeve is moved downward a predetermined distance.

8. The downhole tool of claim 7, further comprising a lower seal disposed between the housing inner wall surface and the sleeve outer wall surface, the lower seal being disposed along the housing inner wall surface below the shoulder, the lower seal being breached when the sleeve is moved downward the predetermine distance, the breaching of the lower seal allowing the acid within the chamber to leak into the housing bore below the sleeve.

9. The downhole tool of claim 8, wherein movement of the sleeve the predetermined distance places the port in fluid communication with the housing bore above the sleeve.

10. A method of fracturing a well, the method comprising the steps of:

(a) providing a downhole tool, the downhole tool comprising a housing having a bore defining an inner wall surface and a port in fluid communication with the inner wall surface and an outer wall surface of the housing, an actuator member operatively associated with the housing, and a chamber operatively associated with the actuator and in fluid communication with the port, the chamber initially isolated from the bore of the housing and initially comprising an acid disposed therein, the actuator comprising a first position in which fluid communication between the bore of the housing and the port is blocked and a second position in which fluid communication between the bore of the housing and the port is established;

(b) disposing the downhole tool at a depth within a wellbore;

(c) actuating the actuator member causing the actuator to move from the first position toward the second position;

(d) during step (c), pumping an acid from the chamber through the port into a location of a well formation;

(e) actuating the actuator member causing the actuator to move to the second position; and then, (f) pumping a fracturing fluid from the bore of the housing through the port, thereby causing the fracturing fluid to be pumped through the port into the location within the well formation.

11. The method of claim 10, wherein the port is blocked by a rupture disk when the actuator is in the first position and during step (c) a pressure increase within the chamber ruptures the rupture disk allowing the acid to be pumped from the chamber through the port into the location of the well formation.

12. The method of claim 10, wherein the port is blocked by a one-way check valve when the actuator is in the first position and during step (c) a pressure increase within the chamber forces the acid from the chamber through the one-way check valve into the location of the well formation.

13. The method of claim 10, wherein the actuator member comprises a sleeve, the sleeve having a seat disposed at an upper end, wherein during step (c) a plug member lands on the seat causing pressure to build above the seat causing the sleeve to move from the first position to the second position so that the acid is pumped from the chamber through the port into the location of the well formation.

14. The method of claim 10, wherein the acid is disposed in a compressible reservoir disposed within the chamber, an interior of the compressible reservoir being in fluid communication with the port, and during step (d) the acid is forced out of the compressible reservoir by the actuator member compressing the compressible reservoir.

15. The method of claim 10, wherein the actuating member is actuated during step (c) by a fracturing fluid being pumped into the bore of the housing

* * * * *

UNITED STATES PATENT AND TRADEMARK OFFICE

CERTIFICATE OF CORRECTION

PATENT NO. : 8,869,898 B2
APPLICATION NO. : 13/109497
DATED : October 28, 2014
INVENTOR(S) : Xu et al.

It is certified that error appears in the above-identified patent and that said Letters Patent is hereby corrected as shown below:

In the Claims,

Column 8, line 28, should read:
15. The method of claim 10, wherein the actuating member is actuated during step (c) by a fracturing fluid being pumped into the bore of the housing.

Signed and Sealed this
Nineteenth Day of May, 2015

Michelle K. Lee

Michelle K. Lee
*Director of the United States Patent and Trademark Office*